US006776218B2

(12) United States Patent
Glutz et al.

(10) Patent No.: US 6,776,218 B2
(45) Date of Patent: Aug. 17, 2004

(54) CASTING STEEL STRIP

(75) Inventors: Andrew Glutz, Figtree (AU); Graham Minter, Figtree (AU)

(73) Assignee: Castrip LLP, Charlotte, NC (US)

( * ) Notice: Subject to any disclaimer, the term of this patent is extended or adjusted under 35 U.S.C. 154(b) by 0 days.

(21) Appl. No.: 10/121,567

(22) Filed: Apr. 12, 2002

(65) Prior Publication Data

US 2002/0153124 A1 Oct. 24, 2002

Related U.S. Application Data

(63) Continuation-in-part of application No. PCT/AU00/01478, filed on Nov. 30, 2000.

(30) Foreign Application Priority Data

Nov. 30, 1999 (AU) ..... PQ4362

(51) Int. Cl.[7] ..... B22D 11/12

(52) U.S. Cl. ..... 164/475; 164/480; 164/415; 164/428

(58) Field of Search ..... 164/475, 479, 164/480, 486, 415, 428, 429, 443

(56) References Cited

U.S. PATENT DOCUMENTS 3,848,656 A * 11/1974 Meylan ..... 164/484
4,000,771 A * 1/1977 Williamson ..... 164/484
4,211,272 A * 7/1980 Schrewe et al. ..... 164/486
4,658,882 A * 4/1987 Oba et al. ..... 164/417
5,657,814 A * 8/1997 Maebara et al. ..... 164/452
5,816,311 A * 10/1998 Osada et al. ..... 164/415
5,901,777 A * 5/1999 Matsumura et al. ..... 164/475
5,904,204 A 5/1999 Teraoka et al.

FOREIGN PATENT DOCUMENTS

JP 58202958 A * 11/1983
JP 62077151 A * 4/1987
JP 05068525 B2 * 9/1993

* cited by examiner

*Primary Examiner*—Kiley Stoner
*Assistant Examiner*—Kevin McHenry
(74) *Attorney, Agent, or Firm*—Barnes & Thornburg

(57) ABSTRACT

A twin roll caster (11) produces thin steel strip (12) which passes through a first enclosure (37) to a pinch roll stand (14) including pinch rolls (50) through which the strip passes into a second enclosure (61). The strip passes horizontally through enclosure (61) to an in-line hot rolling mill (16) which closes the exit end of enclosure (61) and hot rolls the strip as it exits that enclosure. Enclosures (37) and (61) are sealed against ingress of atmospheric air and both maintain oxygen levels less than the surrounding atmosphere to reduce formation of scale on the strip. The second chamber (61) is fitted with water spray nozzles (67, 68) operable to spray fine mist of water droplets onto the upper face of the strip as it passes through that enclosure thereby to generate steam producing a superatmospheric pressure within the enclosure preventing ingress of atmospheric air.

54 Claims, 6 Drawing Sheets

CASTING STEEL STRIP

RELATED APPLICATION

This application is a continuation-in-part of pending International Application PCT/AU00/01478, filed Nov. 30, 2000 and published in English, which application claims priority to Australian Provisional Patent Application No. PQ4362, filed Nov. 30, 1999.

BACKGROUND AND SUMMARY

This invention relates to continuous casting of steel strip in a strip caster, particularly a twin roll caster.

In a twin roll caster molten metal is introduced between a pair of contra-rotated horizontal casting rolls which are cooled so that metal shells solidify on the moving roll surfaces and are brought together at the nip between them to produce a solidified strip product delivered downwardly from the nip between the rolls. The term "nip" is used herein to refer to the general region at which the rolls are closest together. The molten metal may be poured from a ladle into a smaller vessel from which it flows through a metal delivery nozzle located above the nip so as to direct it into the nip between the rolls, so forming a casting pool of molten metal supported on the casting surfaces of the rolls immediately above the nip and extending along the length of the nip. This casting pool is usually confined between side plates or dams held in sliding engagement with end surfaces of the rolls so as to dam the two ends of the casting pool against outflow, although alternative means such as electromagnetic barriers have also been proposed.

When casting steel strip in a twin roll caster, the strip leaves the nip at very high temperatures of the order of 1400° C. and it suffers very rapid scaling due to oxidation at such high temperatures. Such scaling results in a significant loss of steel product. For example, 3% of a 1.55 mm thick strip (typical scale thickness microns) can be lost from oxidation as the strip cools. Moreover, it results in the need to descale the strip prior to further processing to avoid surface quality problems such as rolled-in scale and this causes significant extra complexity and cost. For example, the hot strip material may be passed directly to a rolling mill in line with the strip caster and thence to a run out table on which it emerging from the strip caster progresses so rapidly that it becomes necessary to install descaling equipment to descale the material immediately before it enters the in line rolling ill. Even in cases when the strip is cooled to coiling temperature without hot rolling, it will generally be necessary to descale the strip either before it is coiled or in a later processing step.

To deal with the problem of rapid scaling of strip emerging from a twin roll strip caster it has been proposed to enclose the newly formed strip within a sealed enclosure, or a succession of such enclosures, in which a controlled atmosphere is maintained in order to inhibit oxidation of the strip. The controlled atmosphere can be produced by charging the sealed enclosure or successive enclosures with non-oxidizing gases. Such gases can be inert gases such as nitrogen or argon or exhaust gases from fuel burners.

U.S. Pat. No. 5,762,126 discloses an alternative relatively cheap and energy efficient way of limiting exposure of the high temperature strip to oxygen. The strip is caused to pass through an enclosed space from which it extracts oxygen by the formation of scale and which is sealed so as to control the ingress of oxygen containing atmosphere whereby to control the extent of scale formation. In this method of operation, it is possible to rapidly reach a steady state condition in which scale formation is brought to low levels without the need to deliver a non-oxidizing or reducing gas into the enclosure.

U.S. Pat. No. 5,816,311 discloses a way of controlling the extent of scale formation by providing downstream a chamber where nozzle groups spray a quenching medium onto the strip. The quenching medium was a methyl alcohol, water, or mixture of methyl alcohol and another quenching medium which is liquid at room temperature. It was expected that water spraying in a nitrogen atmosphere would lead to unacceptable levels of oxidation as water contains dissolved oxygen and the breakdown of water (steam) to oxygen and hydrogen would provide further oxidation; however, it was surprisingly and unexpectedly found as described in the '311 patent that it was possible to limit the thickness of oxide on the strip to no more than 0.5 microns. Additionally, it was surprisingly found that these levels of oxide were tolerable for cold rolling without pickling and then metal coating of the strip. This quenching of the steel strip was found, however, to result in uneven cooling of the steel strip introducing stresses and other defects in the strip.

We have now determined that a substantially non-oxidizing atmosphere can be cheaply and effectively produced within an enclosure for the hot steel strip by introducing water in a fine mist spray to generate steam within the enclosure. The steam generation greatly increases the gaseous volume within the enclosure so as to produce a superatmospheric pressure which substantially prevents the ingress of atmospheric air. It can also produce an increased level of hydrogen gas within the enclosure to significantly reduce the oxygen level in the enclosure and retard the rate of oxidation of the strip. Since the casting rolls cannot be exposed to water or steam without risking catastrophic disturbance of the casting pool, it is necessary to isolate the enclosure in which steam is generated from the cooling rolls. However, it has been found that introducing water in a fine mist spray to generate steam within the enclosure produced increased levels of hydrogen gas while tending to avoid liquid water contact with the steel strip resulting in uneven cooling of the strip.

According to the present invention there is provided a method of continuously casting steel strip comprising:

supporting a casting pool of molten steel on one or more chilled casting surfaces;

moving the chilled casting surface or surfaces to produce a solidified steel strip moving away from the casting pool;

guiding the solidified strip successively through first and second enclosures as it moves away from the casting pool;

sealing the first and second enclosures to restrict ingress of atmospheric air; and introducing water into the second enclosure in the form of fine mist to generate steam within the second enclosure and thereby to produce a superatmospheric pressure in that enclosure substantially excluding ingress of atmospheric air.

The first enclosure should be of sufficient length to minimize the possibility of migration of water vapor into the region immediately below the casting rolls. This is accomplished by the first enclosure, and then the second enclosure, being provided to surround the solidified steel strip as the strip moves away from the casting pool such that the strip can be exposed to separate atmospheric conditions in the first enclosure, and thereafter the second enclosure. The strip may exit the first enclosure at a temperature in the range 1300° C. to 1150° C., preferably about 1220° C.

The water may be introduced through one or more fine mist sprays directed onto a face of the steel strip as it passes through the second enclosure. More specifically, the water is preferably introduced through one or more mist sprays directed downwardly onto the upper face of the steel strip. Because the water is introduced in a fine mist spray, the water is converted into steam in the second enclosure while tending to avoid liquid water contact with the steel strip.

In order to produce the spray mist, water may be forcibly propelled by a gas propellant through one or more mist spray nozzles. The gas propellant may be an inert gas, for example nitrogen. The introduction of the water spray mist into the second enclosure produces an increased level of hydrogen gas therein, while tending to avoid liquid water contact with the steel strip and uneven cooling of steel strip.

The strip may be passed from the first enclosure to the second enclosure through a pair of pinch rolls. In that case the pinch rolls may be operated to reduce the strip thickness by up to 5%, and preferably of the order of 2%.

The first and second enclosures may initially be purged with an inert gas, for example nitrogen, before commencement of casting of said strip so as to reduce the initial oxygen content within the enclosures. Such purging may for example reduce the initial content within the enclosures to between 5% to 10% and usually to even lower levels such as 3%.

During casting of said strip the first enclosure may be continuously charged with an inert gas, for example nitrogen. Alternatively, the oxygen content in the first enclosure may be maintained at a level less than the surrounding atmosphere by continuous oxidation of the strip passing therethrough in the manner disclosed in U.S. Pat. No. 5,762,126.

The invention further provides apparatus for casting steel strip comprising:

a pair of generally horizontal casting rolls forming a nip between them;

metal delivery system to deliver molten steel into the nip between the casting rolls to form a casting pool of molten steel supported on the rolls;

a cooling system to chill the casting rolls;

a drive system to rotate the casting rolls in mutually opposite directions whereby to produce a cast strip delivered downwardly from the nip;

strip guides to guide the strip delivered downwardly from the nip through a transit path which takes it away from the nip;

a first enclosure to confine the strip throughout said transit path which enclosure is sealed to control ingress of atmospheric air;

a second enclosure to receive the strip after it has passed through the first enclosure which second enclosure is also sealed to control ingress of atmospheric air; and one or more water sprays operable to spray water into the second enclosure in the form of a fine mist so as to generate steam within the second enclosure.

Preferably, the one or more water sprays comprise one or more water mist spray nozzles mounted within the second enclosure and operable to spray water mist onto the upper face of steel strip. The water mist is such that water generates steam in the second enclosure and tends to avoid liquid water from contacting the steel strip.

In the illustrative method according to the invention, the solidified steel strip may be delivered to a hot rolling mill in which it is hot rolled as it is produced. The strip may exit the second enclosure before entering the rolling mill and in this case the enclosure may comprise a pair of pinch rolls between which the strip passes to exit the second enclosure. However, it is preferred that the strip remain within the second enclosure at its entry into the rolling mill. This may be achieved by sealing the second enclosure against rolls or a housing of the rolling mill.

BRIEF DESCRIPTION OF THE DRAWINGS

In order that the invention may be more fully explained one particular embodiment will be described in detail with reference to the accompanying drawings in which.

DETAILED DESCRIPTION OF THE DRAWINGS

Figure 1:
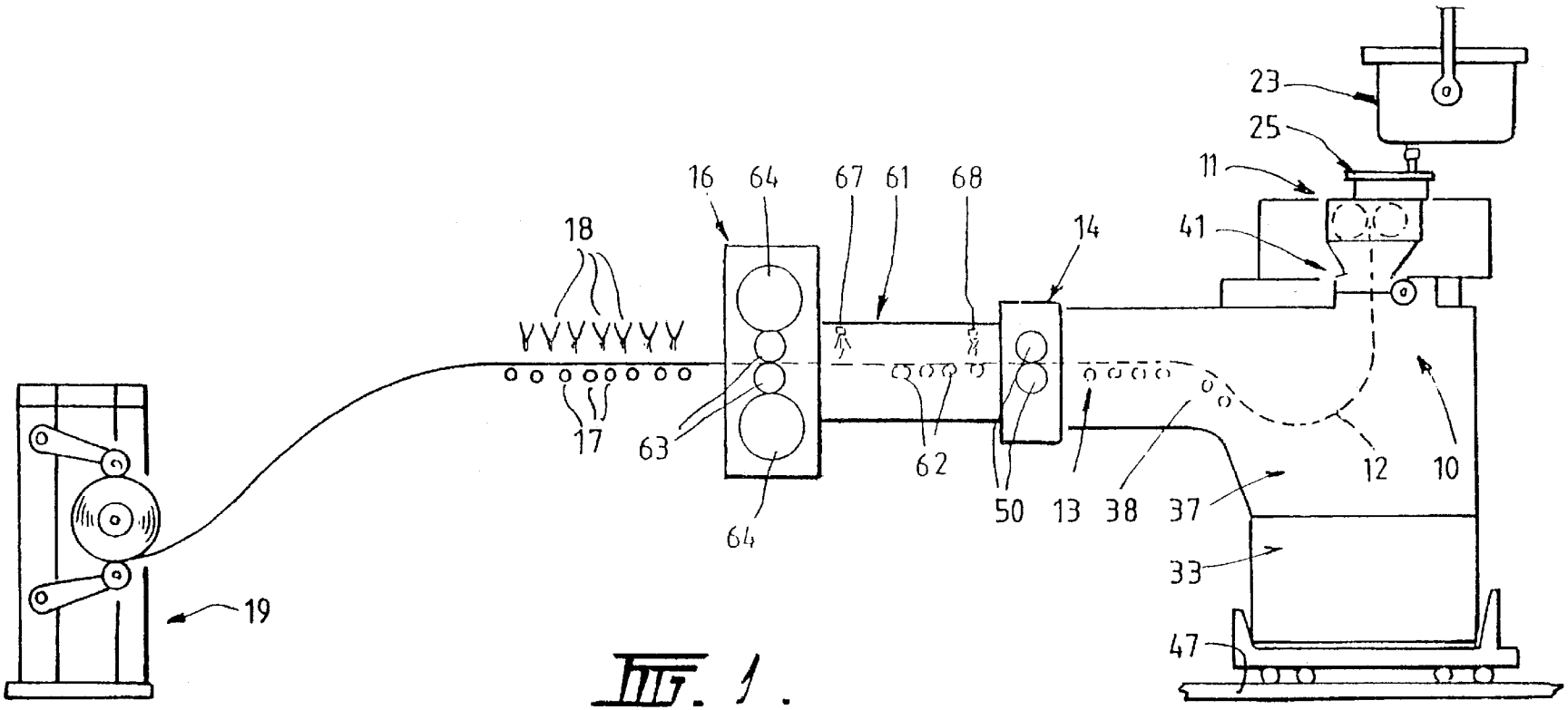
FIG. 1 is a vertical cross-section through a steel strip casting and rolling installation constructed and operated in accordance with the present invention.
Figure 2:
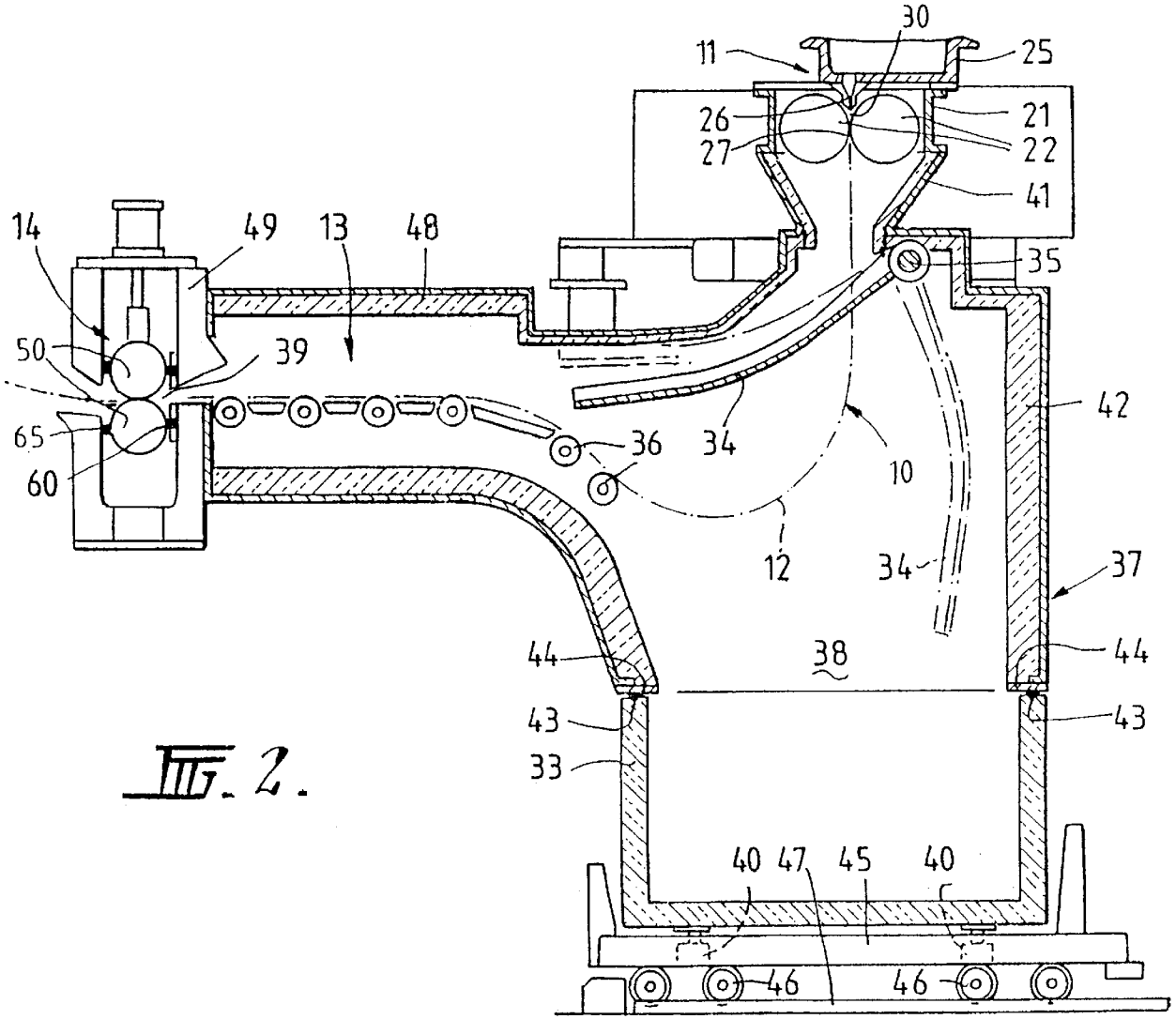
FIG. 2 illustrates essential components of a twin roll caster incorporated in the installation and including a first hot strip enclosure.
Figure 3:
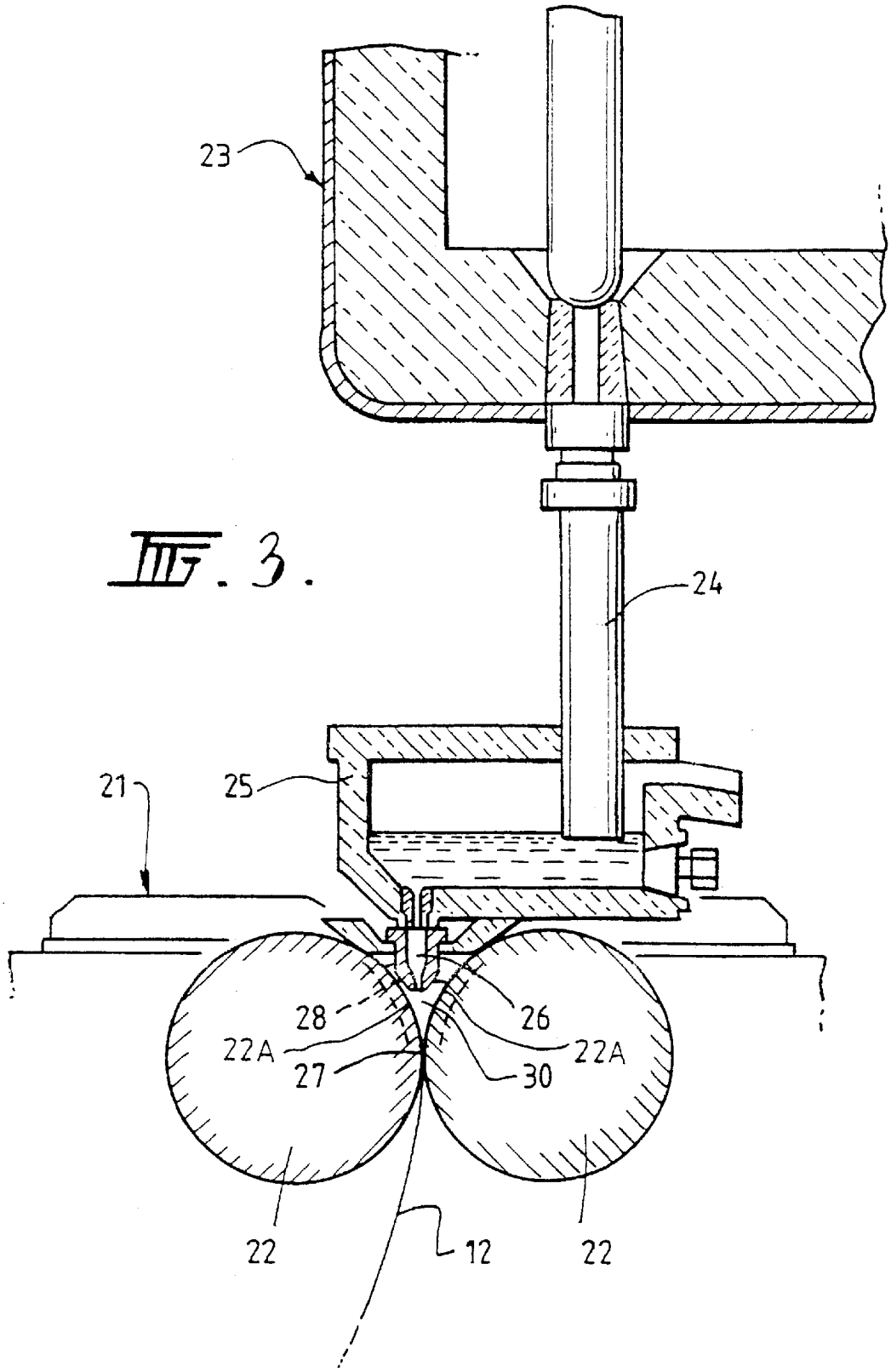
FIG. 3 is a vertical cross-section through the twin roll caster.
Figure 4:
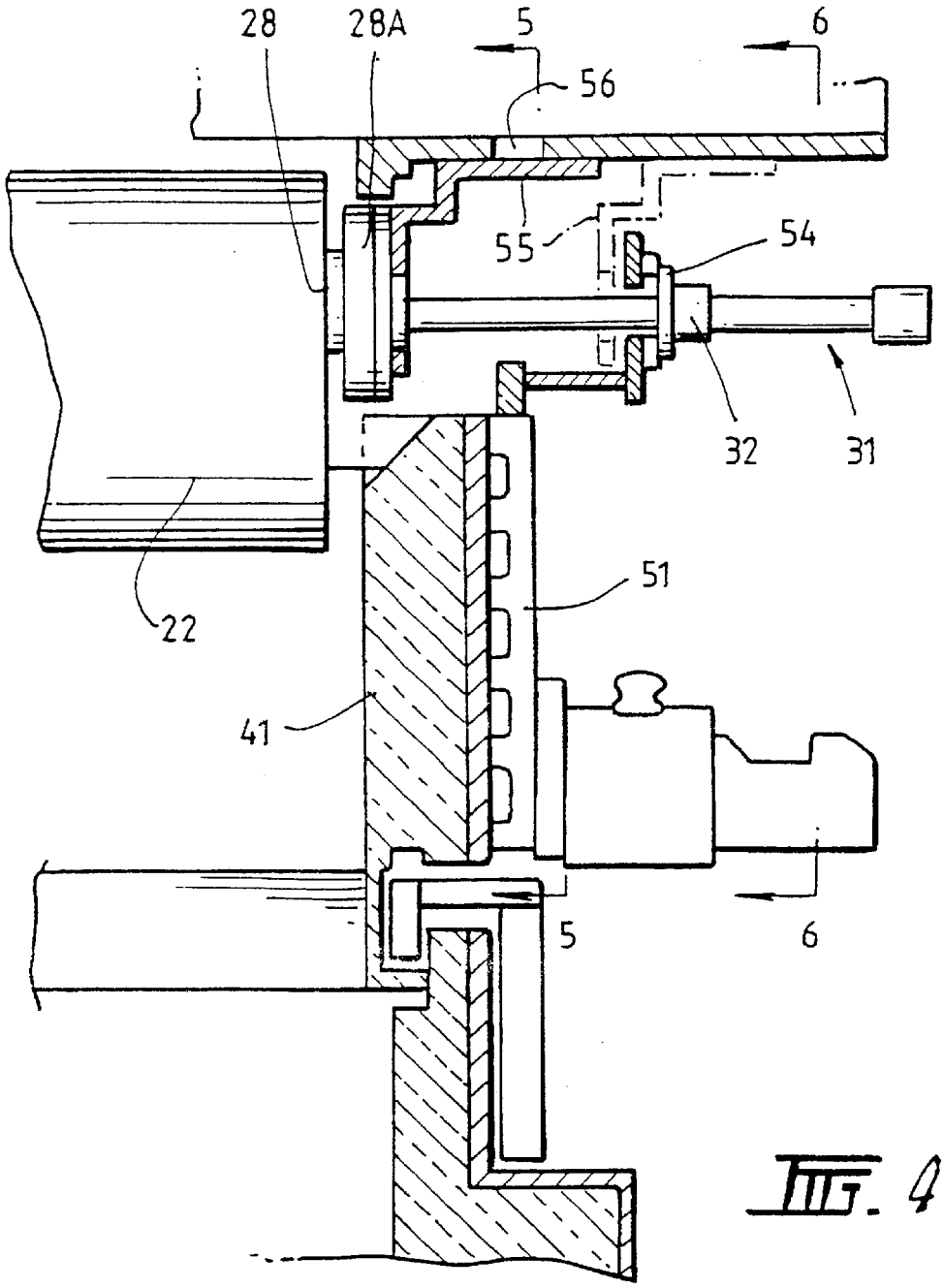
FIG. 4 is a cross-section through end parts of the caster.
Figure 5:
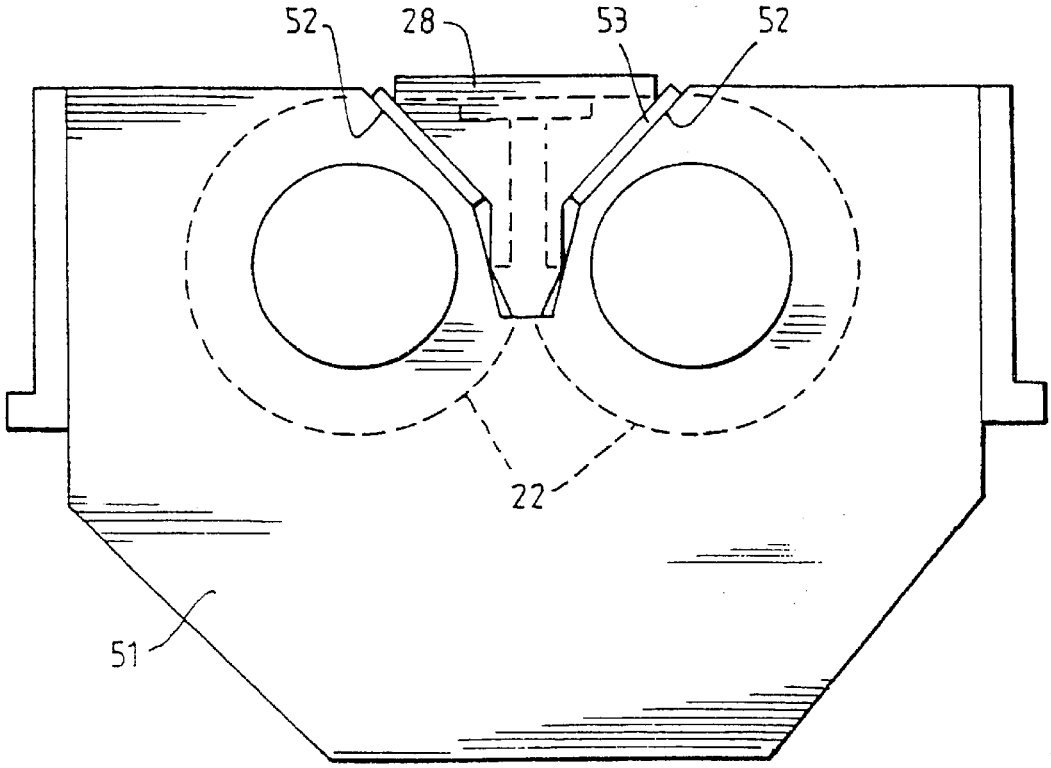
FIG. 5 is a cross-section on the line 5—5 in FIG. 4.
Figure 6:
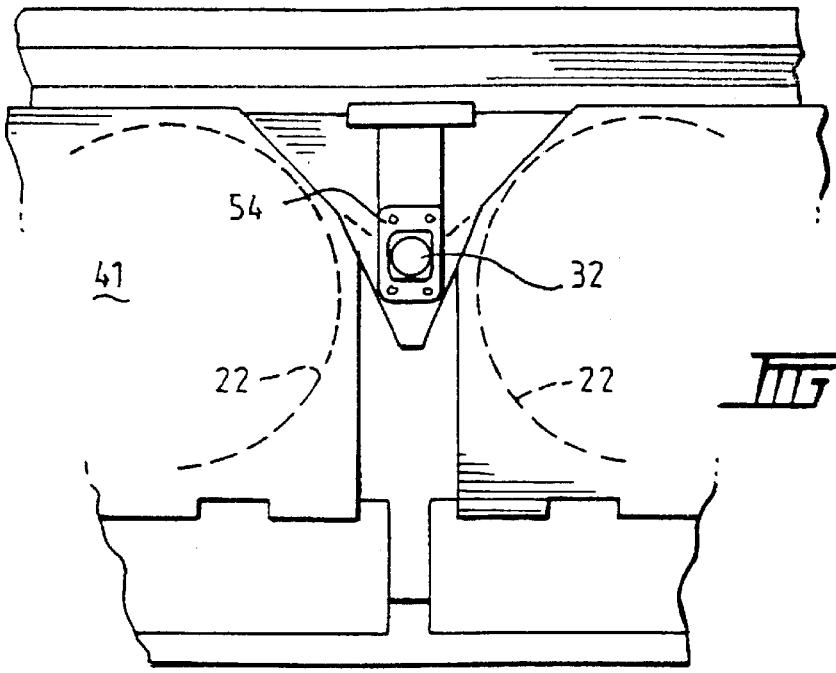
FIG. 6 is a view on the line 6—6 in FIG. 4.
Figure 7:
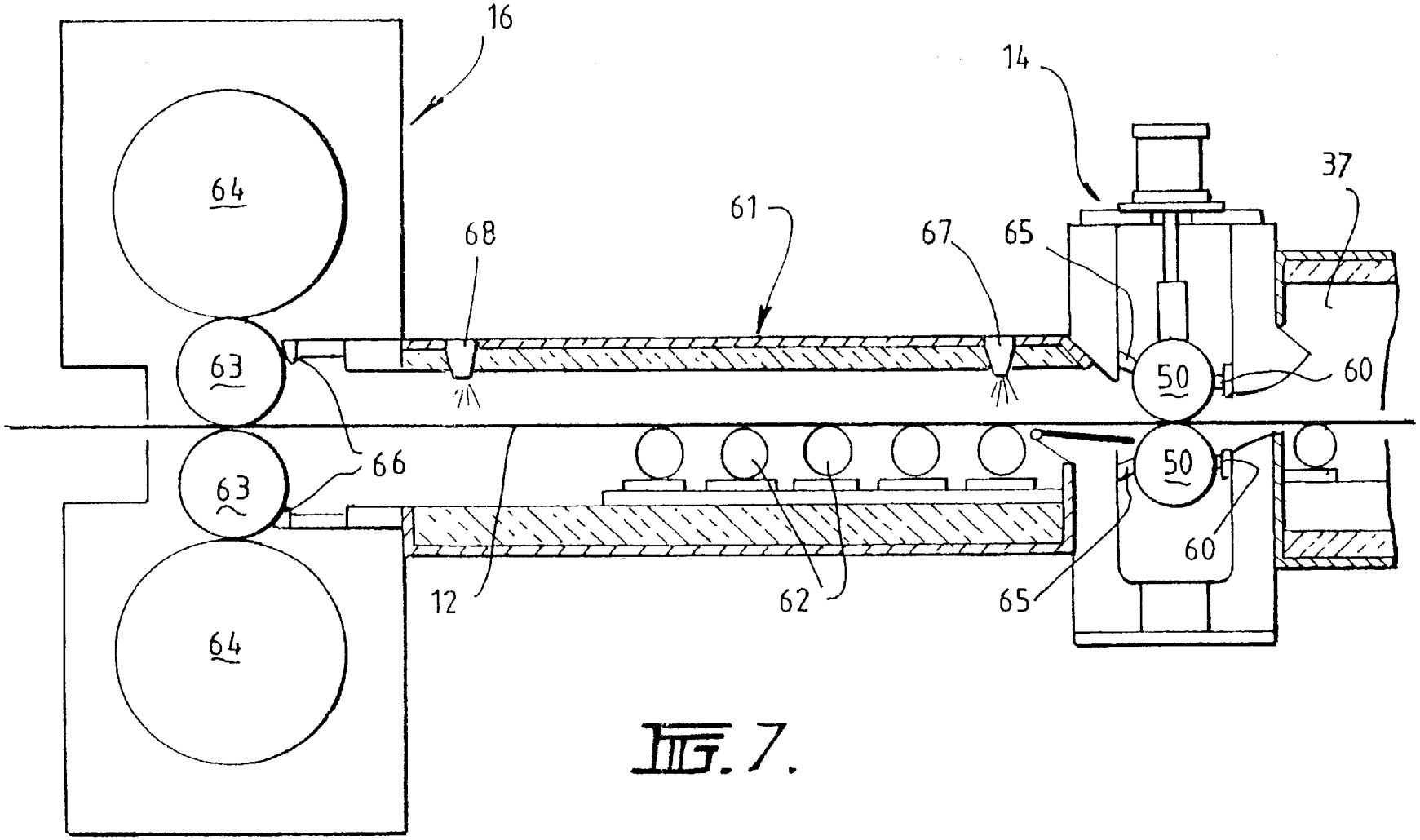
FIG. 7 illustrates a section of the installation downstream from the caster which includes a second strip enclosure and an in-line rolling mill.

The illustrated casting and rolling installation comprises a twin roll caster denoted generally as 11 that produces a cast steel strip 12 which passes in a transit path 10 across a guide table 13 to a pinch roll stand 14. After exiting the pinch roll stand 14 the strip passes to a hot rolling mill 16 in which it is hot rolled to reduce its thickness. The rolled strip exits the rolling mill and passes to a run out table 17 on which it may be force cooled by water jets 18 and thence to a coiler 19.

Twin roll caster 11 comprises a main machine frame 21 which supports a pair of parallel casting rolls 22 having casting surfaces 22A. Molten metal is supplied during a casting operation from a ladle 23 through a refractory ladle outlet shroud 24 to a tundish 25 and thence through a metal delivery nozzle 26 into the nip 27 between the casting rolls 22. Hot metal thus delivered to the nip 27 forms a pool 30 above the nip and this pool 30 is confined at the ends of the rolls by a pair of side closure dams or plates 28 which are applied to stepped ends of the rolls by a pair of thrusters 31 comprising hydraulic cylinder units 32 connected to side plate holders 28A. The upper surface of pool 30 (generally referred to as the "meniscus" level) may rise above the lower end of the de livery nozzle 26 so that the lower end of the delivery nozzle is immersed within this pool.

Casting rolls 22 are water cooled so that shells solidify on the moving roller surfaces and are brought together at the nip 27 between them to produce the solidified strip 12 which is delivered downwardly from the nip between the rolls.

At the start of a casting operation a short length of imperfect strip is produced as the casting conditions stabilize. After continuous casting is established, the casting rolls are moved apart slightly and then brought together again to cause this leading end of the strip to break away in the manner described in Australian Patent Application 27036/92 so as to form a clean head end of the following cast strip. The imperfect material drops into a scrap box 33 located beneath caster 11 and at this time a swinging apron 34 which normally hangs downwardly from a pivot 35 to one side of the caster outlet is swung across the caster outlet to guide the clean end of the cast strip onto the guide table 13 which feeds it to the pinch roll stand 14. Apron 34 is then retracted back to its hanging position to allow the strip 12 to hang in a loop beneath the caster before it passes to the guide table 13 where it engages a succession of guide rollers 36.

The twin roll caster may be of the kind which is illustrated and described in some detail in granted Australian Patents 631728 and 637548 and U.S. Pat. Nos. 5,184,668 and 5,277,243 and reference may be made to those patents for appropriate constructional details which form no part of the present invention.

Between the casting rolls and pinch roll stand 14, the newly formed steel strip is enclosed within a first enclosure denoted generally as 37 defining a sealed space 38. First enclosure 37 is formed by a number of separate wall sections which fit together at various seal connections to form a continuous enclosure wall. These comprise a wall section 41 which is formed at the twin roll caster to enclose the casting rolls and a wall section 42 which extends downwardly beneath wall section 41 to engage the upper edges of scrap box 33 when the scrap box is in its operative position so that the scrap box becomes part of the enclosure. The scrap box and enclosure wall section 42 may be connected by a seal 43 formed by a ceramic fibre rope fitted into a groove in the upper edge of the scrap box and engaging flat sealing gasket 44 fitted to the lower end of wall section 42. Scrap box 33 may be mounted on a carriage 45 fitted with wheels 46 which run on rails 47 whereby the scrap box can be moved after a casting operation to a scrap discharge position. Screw jack units 40 are operable to lift the scrap box from carriage 45 when it is in the operative position so that it is pushed upwardly against the enclosure wall section 42 and compresses the seal 43. After a casting operation the jack units 40 are released to lower the scrap box onto carriage 45 to enable it to be moved to the scrap discharge position.

First enclosure 37 further comprises a wall section 48 disposed about the guide table 13 and connected to the frame 49 of pinch roll stand 14 which includes a pair of pinch rolls 50 against which the enclosure is sealed by sliding seals 60. Accordingly, the strip exits the first enclosure 37 by passing between the entry nip 39 of the pair of pinch rolls 50 and it passes immediately into a second enclosure denoted generally as 61 through which the strip passes to the hot rolling mill 16. Most of the first enclosure wall sections may be lined with fire brick and the scrap box 33 may be lined either with fire brick or with a castable refractory lining. Alternatively, all or parts of the first enclosure wall may be formed by internally water cooled metal panels. The enclosure wall section 41 which surrounds the casting rolls is formed with side plates 51 provided with notches 52 shaped to snugly receive the side dam plate holders 28A when the side dam plates 28 are pressed against the ends of the rolls by the cylinder units 32. The interfaces between the side plate holders 28A and the enclosure side wall sections 51 are sealed by sliding seals 53 to maintain sealing of the first enclosure. Seals 53 may be formed of ceramic fibre rope.

The cylinder units 32 extend outwardly through the enclosure wall section 41 and at these locations the first enclosure is sealed by sealing plates 54 fitted to the cylinder units so as to engage with the enclosure wall section 41 when the cylinder units are actuated to press the side plates against the ends of the rolls. Thrusters 31 also move refractory slides 55 which are moved by the actuation of the cylinder units 32 to close slots 56 in the top of the first enclosure through which the side plates are initially inserted into the enclosure and into the holders 28A for application to the rolls. The top of the first enclosure is closed by the tundish, the side plate holders 28A and the slides 55 when the cylinder units are actuated to apply the side dam plates against the rolls. In this way the complete enclosure 37 is sealed prior to a casting operation to establish the sealed space 38.

The second enclosure 61 serves an extension of the first enclosure 37 in which the strip can be held in a separate atmosphere up to the hot rolling mill 16 which contains a series of pass line rollers 62 to guide strip horizontally through the enclosure to the work rolls 63 of rolling mill 16 which are disposed between two larger backing rolls 64. Second enclosure 61 is sealed at one end against pinch rolls 50 by sliding seals 65 and at its other end it is sealed against the working rolls 63 of rolling mill 16 by sliding seals 66. The sliding seals 65, 66 could be replaced by rotary sealing rolls to run or the strip in the vicinity of the pinch rolls and reduction rolls respectively.

Second enclosure 61 is fitted with a pair of water spray nozzles 67 and 68 that are each operable to spray a fine mist of water droplets downwardly onto the upper face of the steel strip as it passes through the second enclosure, and thereby to generate steam within the second enclosure while tending to avoid liquid water contact with the steel strip. Spray nozzle 67 is mounted in the roof of enclosure 61 downstream from the pinch roll stand 14. Nozzle 68 is located at the other end of enclosure 61 in advance of the rolling mill 16. The nozzles 67 and 68 may be standard commercially available mist spray nozzles operable with a gas propellant to produce a fine spray of water. In the illustrative method of the present invention the gas propellant may be an inert gas such as nitrogen. In a typical installation the nozzles will be operated under nitrogen at a pressure of around 400 kPa. The water may be supplied at around 100–500 kPa pressure, although the pressure of the water is not critical. The nozzles are set up to produce a flat spray across the width of the strip to generate steam within the second enclosure 61.

In operation of the illustrated caster, both of first enclosure 37 and second enclosure 61 may initially be purged with nitrogen gas prior to commencement of casting. Prior to casting, the water sprays are activated so that as soon as the hot strip passes into second enclosure 61 steam is generated within that chamber so as to produce a superatmospheric pressure preventing ingress of atmospheric air. During casting, the first enclosure 37 may continue to be supplied with nitrogen so as to maintain a substantially inert atmosphere. Alternatively, the supply of nitrogen may be terminated after commencement of casting. Initially the strip will take up all of the oxygen from the first enclosure 37 to form heavy scale on the strip. However, the sealing of space 38 of first enclosure 37 controls the ingress of oxygen containing atmosphere below the amount of oxygen that could be taken up by the steel strip. Thus, after an initial start up period the oxygen content in the first enclosure 37 will remain depleted so limiting the availability of oxygen for oxidation of the strip. In this way, the formation of scale is controlled without the need to maintain a supply of nitrogen to the first enclosure space 38.

A twin roll casting and rolling installation as illustrated in the drawings has been operated extensively and testing has been carried out with and without the operation of the water mist sprays 67 and 68. Gas sampling of the atmosphere within second enclosure 61 has shown that operation of the water sprays produces a marked reduction in oxygen content and a very significant increase in hydrogen content as illustrated by the following results:

| | Cast 2M0o23 (No mist Spray) | Cast 2M0o26 (Mist Spray) |
|---|---|---|
| Hydrogen | 0.03% | 2.8% |
| Oxygen | 3.95% | 2.1% |
| Argon | 0.25% | 0.1% |
| Nitrogen | 95.7% | 94.9% |
| Methane | Not Detected | Not detected |
| Carbon Monoxide | <0.01% | 0.01% |
| Carbon Dioxide | 0.03% | 0.01% |

The greatly increased level of hydrogen within second enclosure 61 and the associated marked reduction in oxygen content dramatically reduces scale formation. This increased hydrogen level may be explained by reaction of water molecules under the high temperature conditions surrounding the steel strip within the second enclosure to form hydrogen gas. It is thought that oxygen gas simultaneously formed is taken from water molecules into the strip by oxidation during initial passage of the strip through the second enclosure so as to generate a significant quantity of hydrogen gas. Subsequent oxidation of the strip is suppressed by the hydrogen gas and the superatmospheric pressure within the second enclosure which limits ingress of atmospheric air, but which is sufficient to maintain the hydrogen content in the second enclosure and to produce a very thin layer of scale on the strip which has been found to be desirable on hot rolling to avoid sticking in the roll bite. It has been found that the very thin layer of scale produced in the extremely moist atmosphere in second enclosure 61 serves as a strongly adherent lubricant which minimizes roll wear and operational difficulties at the rolling mill. At the same time, because the fine mist spray is generated into steam in the second enclosure, contact of the steel strip with liquid water tends to be avoided and the prospect of uneven cooling of the strip is substantially reduced if not eliminated.

What is claimed is:

1. A method of continuously casting steel strip comprising:

supporting a casting pool of molten steel on one or more chilled casting surfaces;

moving the chilled casting surface or surfaces to produce a solidified steel strip moving away from the casting pool;

guiding the solidified strip successively through first and second enclosures as it moves away from the casting pool;

sealing the first and second enclosures to restrict ingress of atmospheric air; and introducing water into the second enclosure in the form of fine mist to generate steam without contact with the strip by liquid water within the second enclosure and thereby to produce a superatmospheric pressure in that enclosure substantially excluding ingress of atmospheric air.

2. The method as claimed in claim 1, wherein the strip exits the first enclosure at a temperature in the range of about 1300° to 1150° C.

3. The method as claimed in claim 1, wherein the water is introduced through one or more fine mist sprays directed onto a face of the steel strip as it passes through the second enclosure.

4. The method as claimed in claim 3, wherein the water is introduced through one or more mist sprays directed downwardly onto an upper face of the steel strip.

5. The method as claimed in claim 1, wherein in order to produce the spray mist, water is forcibly propelled by a gas propellant through one or more mist spray nozzles.

6. The method as claimed in claim 5, wherein the gas propellant is an inert gas.

7. The method as claimed in claim 6, wherein the gas propellant is nitrogen.

8. The method as claimed in claim 1, wherein the introduction of the water spray mist into the second enclosure produces an increased level of hydrogen gas therein.

9. The method as claimed in claim 1, wherein the strip is passed from the first enclosure to the second enclosure through a pair of pinch rolls.

10. The method as claimed in claim 9, wherein the pinch rolls are operated to reduce the strip thickness by up to about 5%.

11. The method as claimed in claim 1, wherein the first and second enclosures are initially purged with an inert gas before commencement of casting of said strip so as to reduce the initial oxygen content within the enclosures.

12. The method as claimed in claim 11, wherein the purging reduces the initial oxygen content within the enclosures to between about 5% to 10%.

13. The method as claimed in claim 11, wherein the purging gas is nitrogen.

14. The method as claimed in claim 11, wherein during casting of said strip the first enclosure is continuously charged with inert gas.

15. The method as claimed in claim 11, wherein during casting of said strip the oxygen content in the first enclosure is maintained at a level less than a surrounding atmosphere by continuous oxidation of the strip passing therethrough.

16. The method as claimed in claim 1, wherein the solidified strip is delivered to a hot rolling mill in which it is hot rolled as it is produced.

17. The method as claimed in claim 16, wherein the hot rolling mill is disposed at the exit to the second enclosure and seals that enclosure so as to hot roll the strip as it exits the second enclosure.

18. Apparatus for casting steel strip comprising:

a pair of generally horizontal casting rolls forming a nip between them; a metal delivery system to deliver molten steel into the nip between the casting rolls to form a casting pool of molten steel supported on the rolls;

a cooling system to chill the casting rolls;

a drive system to rotate the casting rolls in mutually opposite directions to produce a cast strip delivered downwardly from the nip;

a strip guide to guide the strip delivered downwardly from the nip through a transit path which takes it away from the nip;

a first enclosure to confine the strip throughout said transit path which enclosure is sealed to control ingress of atmospheric air;

a second enclosure to receive strip after it has passed through the first enclosure which second enclosure is also sealed to control ingress of atmospheric air; and a water spray operable to spray water into the second enclosure in the form of a fine mist so as to generate steam without contact with the strip by liquid water within the second enclosure.

19. The apparatus as claimed in claim 18, wherein the water spray comprises one or more water mist spray nozzles mounted within the second enclosure.

20. The apparatus as claimed in claim 19, wherein the spray nozzles are disposed so as to spray water mist onto an upper face of the steel strip.

21. The apparatus as claimed in claim 18, wherein the first and second enclosures are divided from one another by a pair of pinch rolls.

22. The apparatus as claimed in claim 21, wherein the pinch rolls are operable to reduce the strip thickness.

23. The apparatus as claimed in claim 18, and further comprising a hot rolling mill disposed so as to hot roll the strip as it is produced.

24. The apparatus as claimed in claim 23, wherein the hot rolling mill is disposed at the exit to the second enclosure and seals that enclosure so as to hot roll the strip as it exits the second enclosure.

25. A method of continuously casting steel strip comprising:

supporting a casting pool of molten steel on one or more chilled casting surfaces;

moving the chilled casting surface or surfaces to produce a solidified steel strip moving away from the casting pool;

providing a first enclosure and a second enclosure to surround the solidified steel strip as the strip moves away from the casting pool such that the ship can be exposed to separate atmospheric conditions in the first enclosure and thereafter the second enclosure;

sealing the first and second enclosures to restrict ingress of atmospheric air;

passing the solidified strip through the first enclosure and thereafter the second enclosure; and introducing water into the second enclosure to produce an increased level of hydrogen gas within the second enclosure without contact with the strip by liquid water.

26. The method as claimed in claim 25, wherein the strip exits the first enclosure at a temperature in the range of about 1300° C. to 1150° C.

27. The method as claimed in claim 25, wherein the water is introduced through one or more fine mist sprays directed along at least one face of the steel strip as the strip passes through the second enclosure.

28. The method as claimed in claim 27, wherein the water is introduced through the one or more mist sprays directed downwardly toward an upper face of the steel strip.

29. The method as claimed in claim 27, wherein in order to produce the spray mist, the water is forcibly propelled by a gas propellant through one or more mist spray nozzles.

30. The method as claimed in claim 29, wherein the gas propellant is an inert gas.

31. The method as claimed in claim 30, wherein the gas propellant is nitrogen.

32. The method as claimed in claim 25, wherein the strip is passed from the first enclosure to the second enclosure through a pair of pinch rolls.

33. The method as claimed in claim 32, wherein the pinch rolls are operated to reduce the strip thickness by up to 5%.

34. The method as claimed in claim 25, wherein the first and second enclosures are initially purged with an inert gas before commencement of casting of said strip so as to reduce the initial oxygen content within the enclosures.

35. The method as claimed in claim 34, wherein the purging reduces the initial oxygen content within the enclosures to between about 5% to 10%.

36. The method as claimed in claim 35, wherein the purging gas is nitrogen.

37. The method as claimed in claim 34, wherein during casting of said strip the first enclosure is continuously charged with inert gas.

38. The method as claimed in claim 34, wherein during casting of said strip the oxygen content in the first enclosure is maintained at a level less than a surrounding atmosphere by continuous oxidation of the strip passing therethrough.

39. The method as claimed in claim 25, wherein the solidified strip is delivered to a hot rolling mill in which it is hot rolled as the strip is produced.

40. The method as claimed in claim 39, wherein the hot rolling mill is disposed at the exit to the second enclosure and seals that enclosure so as to hot roll the strip as it exits the second enclosure.

41. Apparatus for casting steel strip comprising:

a pair of generally horizontal casting rolls forming a nip between them;

a metal delivery system to deliver molten steel into the nip between the casting rolls to form a casting pool of molten steel supported on the rolls;

a cooling system to chill the casting rolls;

a drive system to rotate the casting rolls in mutually opposite directions to produce a cast strip delivered downwardly from the nip;

at least one strip guide to guide the strip delivered downwardly from the nip through a transit path which takes it away from the nip;

a first enclosure sealed to control ingress of atmospheric air and surrounding the strip through at least part of said transit path;

a second enclosure separate from the first enclosure also sealed to control ingress of atmospheric air and capable of receiving the strip after it has passed through the first enclosure; and at least one water spray operable to spray water into the second enclosure to produce an increased level of hydrogen gas within the second enclosure without contact with the strip by liquid water.

42. The apparatus as claimed in claim 41, wherein the at least one water spray comprises one or more water mist spray nozzles mounted within the second enclosure.

43. The apparatus as claimed in claim 42, wherein the one or more spray nozzles are disposed so as to spray water mist toward an upper face of the steel strip.

44. The apparatus as claimed in claim 41, wherein the first and second enclosures are separated from one another by a pair of pinch rolls.

45. The apparatus as claimed in claim 44, wherein the pinch rolls are operable to reduce the strip thickness.

46. The apparatus as claimed in claim 41, and further comprising a hot rolling mill disposed so as to hot roll the strip as it is produced.

47. The apparatus as claimed in claim 46, wherein the hot rolling mill is disposed at the exit to the second enclosure and seals that enclosure so as to hot roll the strip as it exits the second enclosure.

48. A method of continuously casting steel strip comprising:

supporting a casting pool of molten steel on one or more chilled casting surfaces;

moving the chilled casting surface or surfaces to produce a solidified steel strip moving away from the casting pool;

guiding the solidified strip successively through first and second enclosures as it moves away from the casting pool;

sealing the first and second enclosures to restrict ingress of atmospheric air; and introducing water into the second enclosure in the form of fine mist to generate steam within the second enclosure and thereby to produce a superatmospheric pressure in that enclosure substantially excluding ingress of atmospheric air wherein the strip exits the first enclosure at a temperature in the range of about 1300° C. to 1150° C.

49. A method of continuously casting steel strip comprising:

supporting a casting pool of molten steel on one or more chilled casting surfaces;

moving the chilled casting surface or surfaces to produce a solidified steel strip moving away from the casting pool;

guiding the solidified strip successively through first and second enclosures as it moves away from the casting pool;

sealing the first and second enclosures to restrict ingress of atmospheric air; and introducing water into the second enclosure in the form of fine mist to generate steam within the second enclosure and thereby to produce a superatmospheric pressure in that enclosure substantially excluding ingress of atmospheric air, wherein the first and second enclosures are initially purged with an inert gas before commencement of casting of said strip so as to reduce the initial oxygen content within the enclosures, and wherein during casting of said strip the oxygen content in the first enclosure is maintained at a level less than a surround atmosphere by continuous oxidation of the strip passing therethrough.

50. A method of continuously casting steel strip comprising:

supporting a casting pool of molten steel on one or more chilled casting surfaces;

moving the chilled casting surface or surfaces to produce a solidified steel strip moving away from the casting pool;

guiding the solidified strip successively through first and second enclosures as it moves away from the casting pool;

sealing the first and second enclosures to restrict ingress of atmospheric air; and introducing water into the second enclosure in the form of fine mist to generate steam within the second enclosure and thereby to produce a superatmospheric pressure in that enclosure substantially excluding ingress of atmospheric air, wherein the solidified strip is delivered to a hot rolling mill in which it is hot rolled as it is produced, and wherein the hot rolling mill is disposed at the exit to the second enclosure and seals that enclosure so as to hot roll the strip as it exits the second enclosure.

51. Apparatus for casting steel strip comprising:

a pair of generally horizontal casting rolls forming a nip between them;

a metal delivery system to deliver molten steel into the nip between the casting rolls to form a casting pool of molten steel supported on the rolls;

a cooling system to chill the casting rolls;

a drive system to rotate the casting rolls in mutually opposite directions to produce a cast strip delivered downwardly from the nip;

a strip guide to guide the strip delivered downwardly from the nip through a transit path which takes it away from the nip;

a first enclosure to confine the strip throughout said transit path which enclosure is sealed to control ingress of atmospheric air;

a second enclosure to receive strip after it has passed through the first enclosure which second enclosure is also sealed to control ingress of atmospheric air;

a water spray operable to spray water into the second enclosure in the form of a fine mist so as to generate steam within the second enclosure; and a hot rolling mill disposed at the exit to the second enclosure so as to seal the second enclosure and to hot roll the strip as it exits the second enclosure.

52. A method of continuously casting steel strip comprising:

supporting a casting pool of molten steel on one or more chilled casting surfaces;

moving the chilled casting surface or surfaces to produce a solidified steel strip moving away from the casting pool;

providing a first enclosure and a second enclosure to surround the solidified steel strip as the strip moves away from the casting pool such that the strip can be exposed to separate atmospheric conditions in the first enclosure and thereafter the second enclosure;

sealing the first and second enclosures to restrict ingress of atmospheric air;

passing the solidified strip through the first enclosure and thereafter the second enclosure; and introducing water into the second enclosure to produce an increased level of hydrogen gas within the second enclosure without liquid water contact with the steel strip;

wherein the water is introduced through one or more fine mist sprays directed downwardly toward an upper face of the steel strip as the strip passes through the second enclosure.

53. A method of continuously casting steel strip comprising:

supporting a casting pool of molten steel on one or more chilled casting surfaces;

moving the chilled casting surface or surfaces to produce a solidified steel strip moving away from the casting pool;

providing a first enclosure and a second enclosure to surround the solidified steel strip as the strip moves away from the casting pool such that the strip can be exposed to separate atmospheric conditions in the first enclosure and thereafter the second enclosure;

sealing the first and second enclosures to restrict ingress of atmospheric air;

passing the solidified strip through the first enclosure and thereafter the second enclosure; and introducing water into the second enclosure to produce an increased level of hydrogen gas within the second enclosure without liquid water contact with the steel strip;

wherein the first and second enclosures are initially purged with an inert gas before commencement of casting of said strip so as to reduce the initial oxygen content within the enclosures, and wherein the oxygen content in the first enclosure is maintained at a level less than a surrounding atmosphere by continuous oxidation of the strip passing therethrough.

54. Apparatus for casting steel strip comprising:

a pair of generally horizontal casting rolls forming a nip between them;

a metal delivery system to deliver molten steel into the nip between the casting rolls to form a casting pool of molten steel supported on the rolls;

a cooling system to chill the casting rolls;

a drive system to rotate the casting rolls in mutually opposite directions to produce a cast strip delivered downwardly from the nip;

at least one strip guide to guide the strip delivered downwardly from the nip through a transit path which takes it away from the nip;

a first enclosure sealed to control ingress of atmospheric air and surrounding the strip through at least part of said transit path;

a second enclosure separate from the first enclosure also sealed to control ingress of atmospheric air and capable of receiving the strip after it has passed through the first enclosure; and at least one water spray operable to spray water into the second enclosure to produce an increased level of hydrogen gas within the second enclosure without liquid water contact with the steel strip, wherein the solidified strip is delivered to a hot rolling mill in which it is hot rolled as it is produced, and wherein the hot rolling mill is disposed at the exit to the second enclosure and seals that enclosure so as to hot roll the strip as it exits the second enclosure.

* * * * *